US010601169B2

(12) United States Patent
Teramoto

(10) Patent No.: US 10,601,169 B2
(45) Date of Patent: Mar. 24, 2020

(54) CONNECTOR

(71) Applicant: Sumitomo Wiring Systems, Ltd., Yokkaichi, Mie (JP)

(72) Inventor: Keisuke Teramoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/274,374

(22) Filed: Feb. 13, 2019

(65) Prior Publication Data

US 2019/0280426 A1 Sep. 12, 2019

(30) Foreign Application Priority Data

Mar. 6, 2018 (JP) ..... 2018-039843

(51) Int. Cl.

| | |
|---|---|
| ***H01R 13/52*** | (2006.01) |
| ***H01R 13/502*** | (2006.01) |
| ***H01R 13/629*** | (2006.01) |
| ***H01R 13/518*** | (2006.01) |

(52) U.S. Cl.

CPC ..... *H01R 13/5227* (2013.01); *H01R 13/502* (2013.01); *H01R 13/518* (2013.01); *H01R 13/62933* (2013.01)

(58) Field of Classification Search

CPC ..... H01R 13/5227

See application file for complete search history.

(56) References Cited

U.S. PATENT DOCUMENTS

| | | | | |
|---|---|---|---|---|
| 10,163,590 | B2 * | 12/2018 | Tabata | H01R 13/701 |
| 2012/0297613 | A1 | 11/2012 | Shinkawa et al. | |
| 2014/0295687 | A1 | 10/2014 | Shinkawa et al. | |
| 2019/0280426 | A1 * | 9/2019 | Teramoto | H01R 13/62933 |
| 2019/0280431 | A1 * | 9/2019 | Teramoto | H01R 13/514 |

FOREIGN PATENT DOCUMENTS

| | | |
|---|---|---|
| JP | 5466025 | 4/2014 |

* cited by examiner

*Primary Examiner* — Ross N Gushi

(74) *Attorney, Agent, or Firm* — Gerald E. Hespos; Michael J. Porco; Matthew T. Hespos

(57) ABSTRACT

A connector (1) into which a mating connector (female connector 101) is fittable from front includes a tubular receptacle (40) having a forwardly open fitting opening (50) capable of accommodating the mating connector (101) fit through the fitting opening (50). A drainage recess (70) penetrate in a direction perpendicular to a front-rear direction at a position retracted from the fitting opening (50) in the receptacle (40). Partitioning ridges (60) are at positions retracted from the fitting opening (50) and project in a direction intersecting the front-rear direction from the receptacle (40). A front end (first rib end 61A) of some partitioning ridge (first rib 61) is coupled to and flush with a back wall (72) of the drainage recess (70).

4 Claims, 5 Drawing Sheets

CONNECTOR

BACKGROUND

Field of the Invention

This specification relates to a connector.

Related Art

Japanese Patent No. 5466025 discloses a connector obtained by connecting a male connector and a female connector. The female connector has a substantially rectangular parallelepiped shape and the male connector has a substantially box shape. A cylindrical action point projection projects on an outer side of the female connector, and a recessed grove extending from the vicinity of a base end of the action point projection toward a side to be connected to the male connector. A substantially V-shaped cutout is provided in a fitting opening of the male connector to be fit to the female connector, and a rib on an inner peripheral surface extends back from a position somewhat behind the cutout. With the female connector and the male connector connected, the rib of the male connector is inserted in the groove of the female connector and the action point projection of the female connector is inserted in the cutout of the male connector.

However, liquid, such as water, splashed from above runs along the fitting opening and pools in the cutout if the connector is mounted with the fitting opening of the female connector and the male connector oriented horizontally. Parts of the liquid having entered above and below the rib may be connected conductively to form a leak passage.

SUMMARY

The invention relates to a connector into which a mating connector can fit from the front. A tubular fitting opening is open forward in the connector and has a tubular shape capable of accommodating the mating connector fit therein through the fitting opening. A drainage recess penetrates in a direction perpendicular to a front-rear direction at a position retracted from the fitting opening in the receptacle. Partitioning ridges are provided at positions retracted from the fitting opening and projecting in a direction intersecting the front-rear direction from the receptacle. A front end of some of the partitioning ridges are coupled to and flush with a back wall of the drainage recess. According to this configuration, the partitioning ridges are retracted from the fitting opening in an inserting direction of the mating connector. Thus, the mating connector and the receptacle are positioned initially by lightly fitting the mating connector into the fitting opening when connecting the mating connector and, thereafter, a connecting operation is performed. In this way, even if the connector is installed in a place difficult for a worker to see and the worker connects the mating connector by touch, a feeling of fitting the mating connector into the fitting opening (so-called fit-in feeling) can be obtained and work efficiency is improved.

Further, a clearance is set between an outer wall of the mating connector and an inner wall of the receptacle to enable the connecting operation, and water can intrude into this clearance from the front. If the connector does not include the drainage recess, liquid spreads in the clearance due to surface tension and may form a leak passage that shorts terminals in the receptacle to each other. In contrast, according to the above configuration, the ends of some partitioning ridges on a fitting side are coupled to and flush with the back wall of the drainage recess. Thus, clearances are eliminated at the position of the fitting side end of the partitioning ridge and the liquid is divided at some partitioning ridges and drained from the drainage recess. In this way, the leak passage is prevented.

The drainage recess may include a lower edge inclined down toward the fitting opening. According to this configuration, the liquid divided into upper and lower parts at the front end of the some partitioning ridges is drained toward the fitting opening along the drainage lower edge part. Thus, the formation of the leak passage across the partitioning ridges can be prevented more reliably.

The partitioning ridges may include a first rib coupled to and flush with the back wall of the drainage recess and second positioning ribs on a rear side of a part of the fitting opening where the drainage recess is not provided and in front of the first rib. The second positioning ribs may extend rearward from the same position in the front-rear direction. According to this configuration, the mating connector is guided in a proper posture in a fitting direction by being fit into the fitting opening. Thus, work efficiency when fitting the mating connector is good. Further, if the positioning ribs are provided above the first rib, liquid is divided into upper and lower parts by the drainage recess at the first rib even if the liquid splashed from above flows down toward the first rib from the front ends of the positioning ribs. Thus, a leak passage is not formed across the first rib. Therefore, terminals largely affected by leakage can be arranged below the first rib.

According to the connector disclosed in this specification, it is possible to prevent the formation of a leak passage when water splashes.

DETAILED DESCRIPTION

An embodiment is described with reference to FIGS. 1 to 5.

Figure 1:
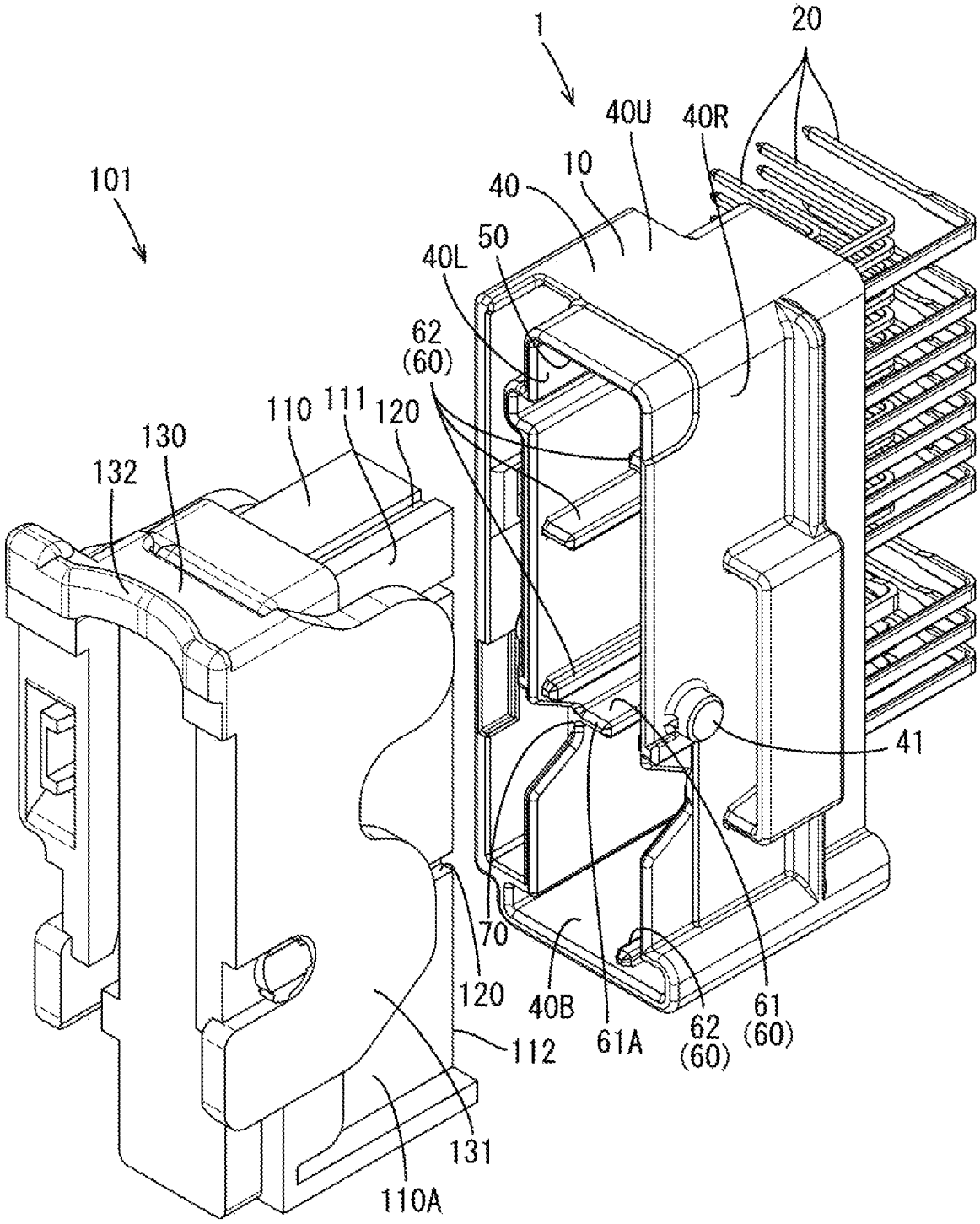
FIG. 1 is a perspective view of a male connector and a female connector of an embodiment.

A connector 1 of this embodiment is a male connector for a board to be installed in an unillustrated vehicle interior, and connectable to a female connector 101 serving as a mating connector as shown in FIG. 1. In the following description, directions to bring the male connector 1 and the female connector 101 toward each other are referred to as forward directions and opposite directions are referred to as rearward directions on the basis of fitting directions of the male connector 1 and the female connector 101. A lateral direction of the male connector 1 is described based on FIG. 3. Further, for a plurality of identical members, only one member may be denoted by a reference sign and the other(s) may not be denoted by the reference sign in figures.

(Overall Configuration)

The female connector 101 is made of synthetic resin and includes, as shown in FIG. 1, a female housing 110 in the form of a substantially rectangular block and unillustrated female terminals are held in the female housing 110. A lever 130 is assembled rotatably with the female housing 110.

The lever 130 includes two cam plates 131 each of which has an unillustrated cam groove, and a rotating portion 132 couples the cam plates 131 at one end. The lever 130 and is rotatable between an initial position and a connection position with rotary shafts as supports. The connection of the female connector 101 to the male connector 1 is assisted by operating the rotating portion 132 and rotationally displacing the cam plates 131 with the rotary shafts as supports, thereby pulling the female connector 101 toward cam shafts 41 provided on a receptacle 40 of the male connector 1. The lever 130 is fit lightly into the receptacle 40 when the lever 130 is at the initial position to start a connecting operation. The connecting operation is performed by rotating the lever 130 from the initial position to the connection position. The lever 130 is at the connection position in FIG. 1.

As shown in FIG. 1, the male connector 1 includes a male housing 10 made of synthetic resin and male terminals 20.

Figure 4:
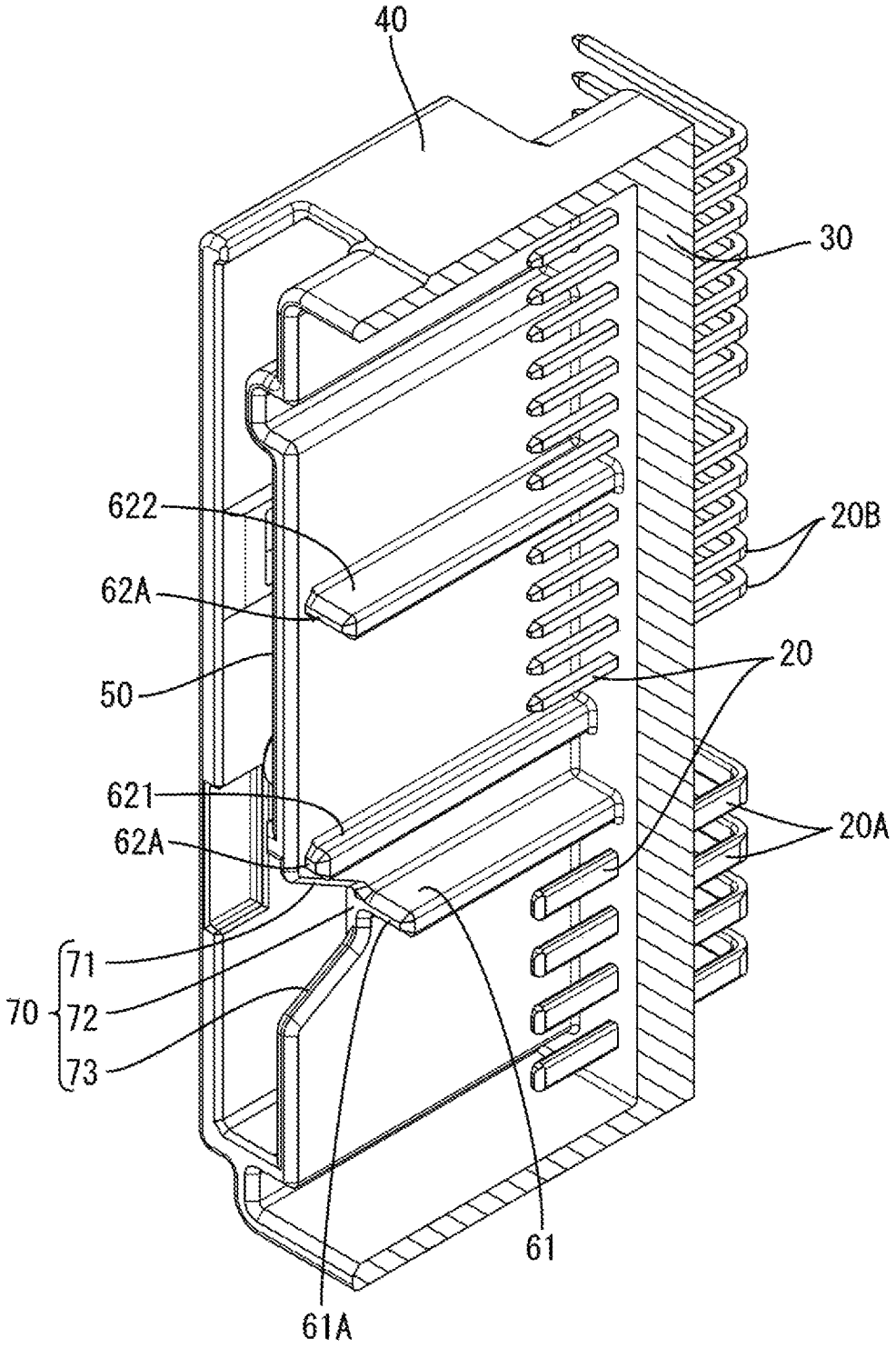
FIG. 4 is a perspective view in section of the male connector.

As shown in FIG. 4, the male housing 10 includes a holding wall 30 for holding the terminals and the tubular receptacle 40 extending forward from the holding wall 30. The receptacle 40 is provided with a forwardly open fitting opening 50 that includes a peripheral wall constituting a front edge of an opening of the receptacle 40. The female housing 110 is fit into the receptacle 40 through the fitting opening 50.

As shown in FIG. 4, the male terminal 20 is formed from a wire material that is excellent in conductivity. The wire material is bent into an L shape and is held in the holding wall 30 with a front end part thereof projecting forward. When the female housing 110 is fit into the receptacle 40, the front part of each male terminal 20 is inserted into the female housing 110 and is connected electrically to each female terminal.

(Partitioning Ridges 60)

Figure 3:
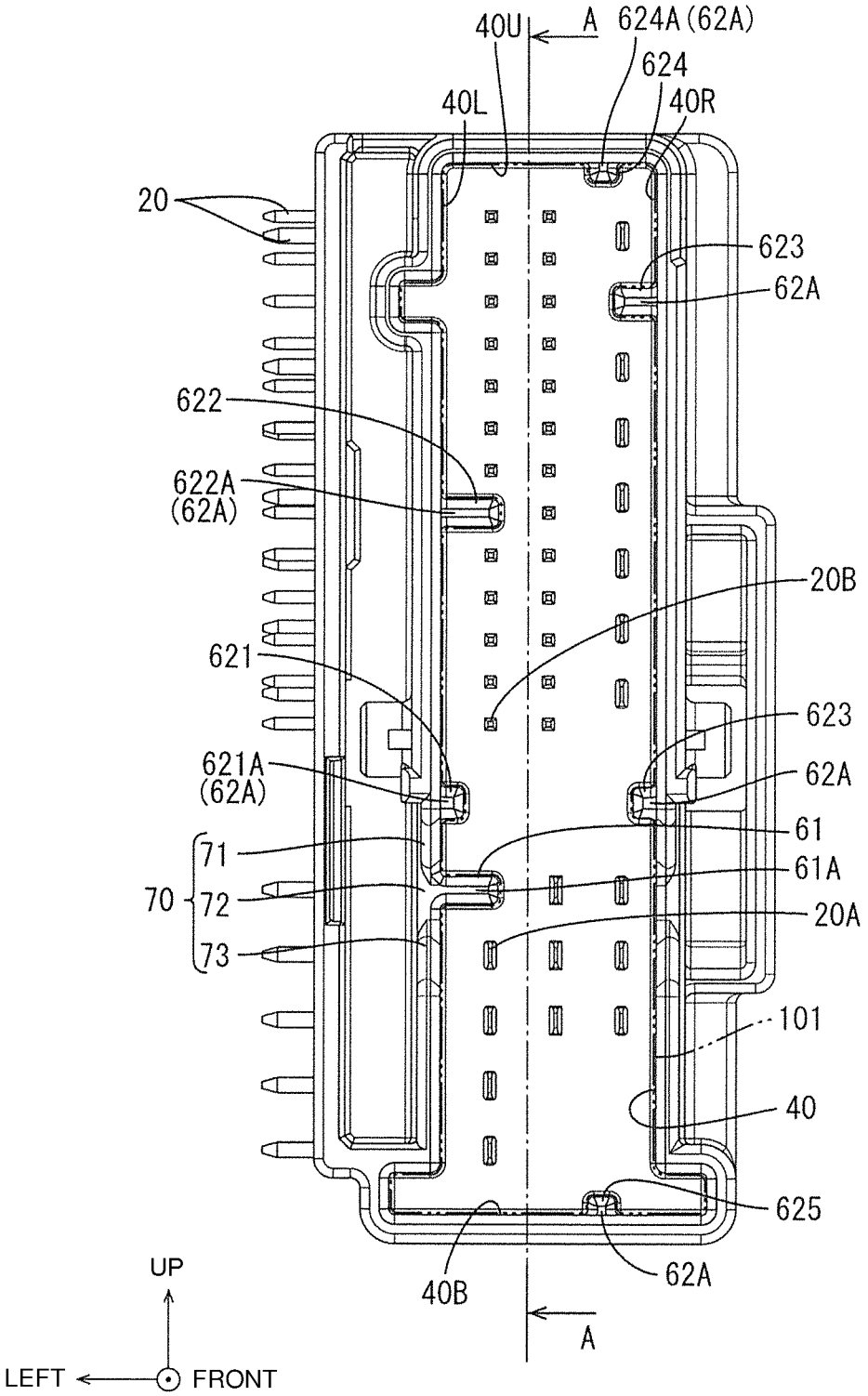
FIG. 3 is a front view of the male connector.

As shown in FIG. 1, partitioning ridges 60 are provided on an inner wall of the receptacle 40. The partitioning ridges 60 rise vertically from the inner wall of the receptacle 40 and extend in the front-rear direction. In particular, the partitioning ridges 60 include positioning ribs 62 extending rearward from positions behind the fitting opening 50 and a first rib 61 (an example of "some partitioning ridge") extending rearward from a position behind the positioning ribs 62. Left and right walls 40L, 40R of the receptacle 40 extend vertically. The first rib 61 is provided substantially at a ⅓ height position from the lower end on the left wall 40L of the receptacle 40. As shown in FIG. 3, the positioning ribs 62 include an auxiliary rib 621 right above the first rib 61 on the left wall 40L of the receptacle 40, a second rib 622 provided substantially at a ⅓ height position from the upper end of the left wall 40L, upper and lower right wall ribs 623 provided on the right wall 40R of the receptacle 40, a ceiling wall rib 624 provided on a ceiling wall 40U of the receptacle 40 and a bottom wall rib 625 provided on a bottom wall 40B of the receptacle 40. The front ends of the first rib 61, the positioning ribs 62, the auxiliary rib 621 and the second rib 622 may be referred to as a first rib end 61A, positioning rib ends 62A, an auxiliary rib end 621A and an auxiliary rib end 622A below.

Figure 5:
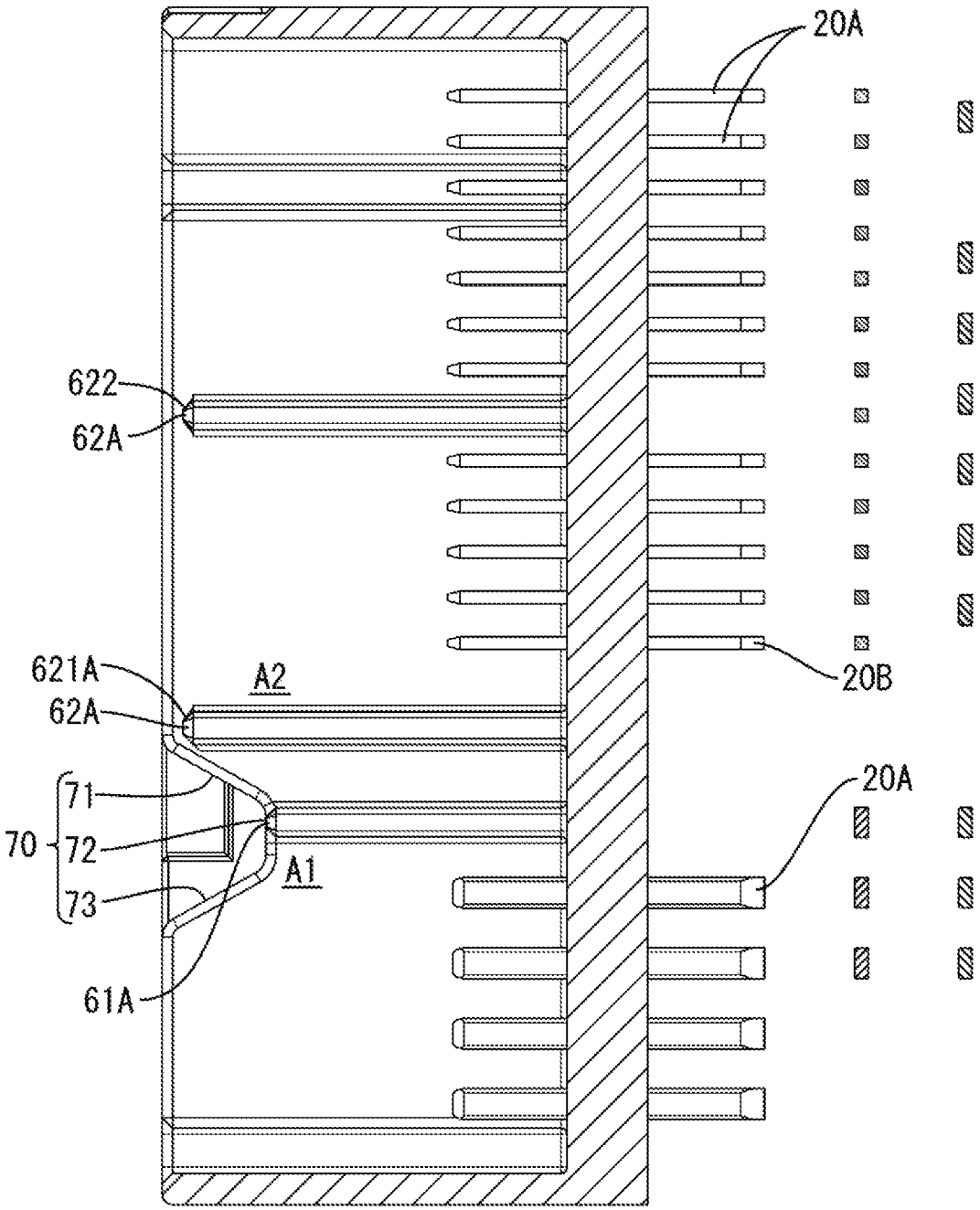
FIG. 5 is a section along A-A of FIG. 3.

The respective positioning rib ends 62A are set at the same position in the front-rear direction, as shown in FIG. 5. The first rib end 61A is at a position retracted from the positioning rib ends 62A.

(Fitting of Ribs and Fitting Grooves 120)

As shown in FIG. 1, an outer wall 110A of the female housing 110 is provided with fitting grooves 120 at positions corresponding to the respective partitioning ridges 60 of the male connector 1 in the vertical direction. Each fitting groove 120 is recessed inward of the female housing 110, extends in the front-rear direction, and is shaped and dimensioned such that each partitioning ridge 60 can fit therein. A fitting end 112 of the female housing 110 is a flat surface perpendicular to the front-rear direction.

Figure 2:
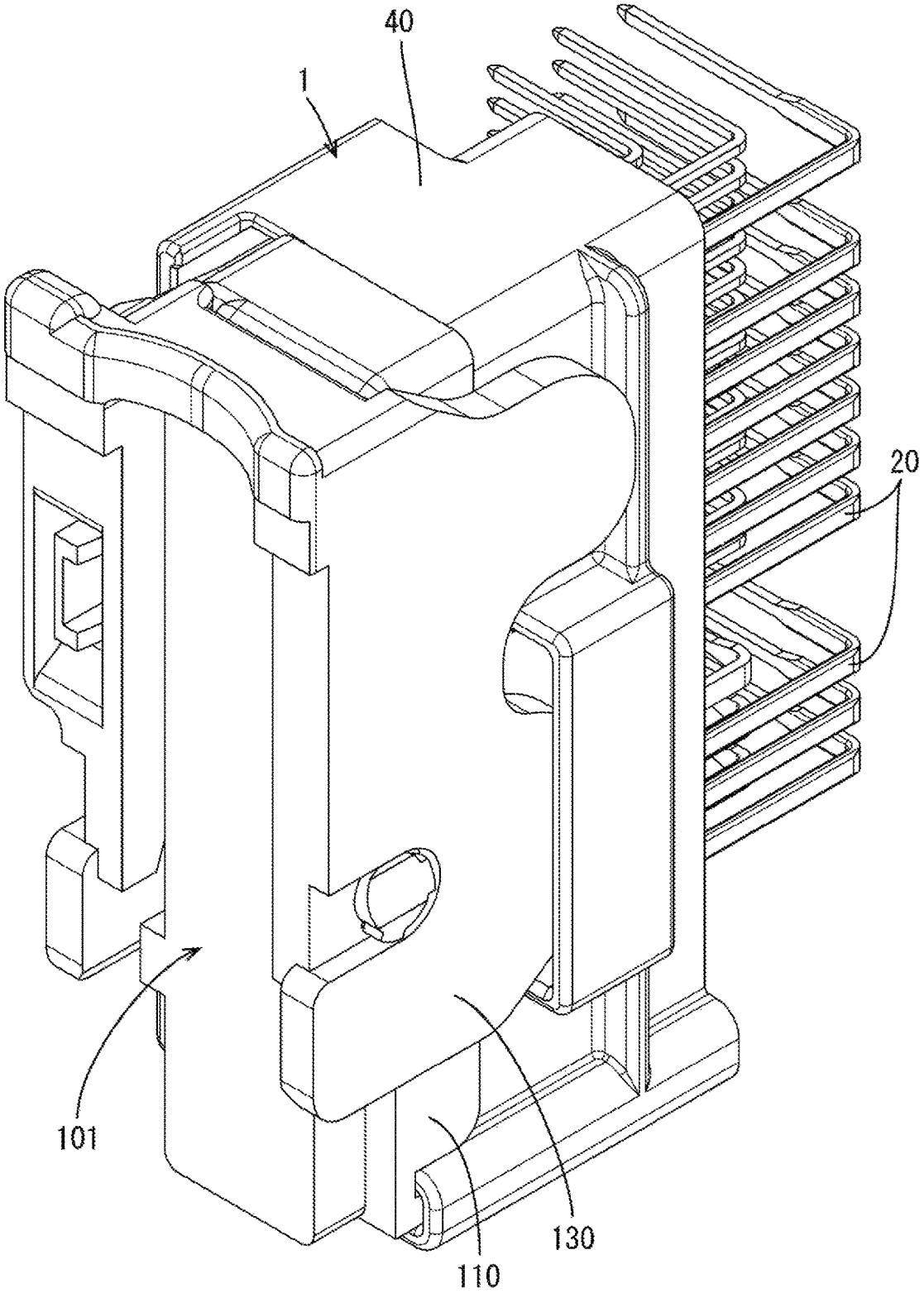
FIG. 2 is a perspective view showing a state where the male connector and the female connector are connected to each other.

The female connector 101 is connected to the male connector 1 by bringing the fitting end 112 of the female housing 110 into contact with the fitting opening 50 of the receptacle 40 and, in that state, the female housing 110 is moved appropriately in vertical and/or lateral direction(s) along the fitting opening 50. All of the fitting end 112 eventually is fit lightly into the fitting opening 50 to position the female housing 110 and the receptacle 40. If the female housing 110 is pushed forward (toward the back in the receptacle 40), the fitting grooves 120 of the female housing 110 move to the back of the receptacle 40 while being guided by the respective positioning ribs 62 and the first rib 61. The locking of the lever 130 at the initial position is released, and the lever 130 is rotated from the initial position to the connection position such that the lever 130 is locked and connected to the male connector 1, as shown in FIG. 2. Thus, a worker can connect the female connector 101 to the male connector 1 of this embodiment by touch without visually confirming a correct position and an opening direction of the fitting opening 50 of the receptacle 40.

(Drainage Configuration)

With the female connector 101 and the male connector 1 connected, a clearance is set between the female housing 110 and the receptacle 40, as shown in FIG. 2. This clearance enables the connecting operation of the connectors 101, 1 in consideration of dimensional tolerances of the female connector 101 and the male connector 1.

Water that may be splashed on the connector while the female housing 110 is fit in the receptacle 40 spreads in the clearance due to surface tension and form a leak passage that shorts the male terminals 20 to each other. Further, in this embodiment, the male terminals 20A disposed substantially in a lower ⅓ range in the receptacle 40 need to be insulated reliably from the male terminals 20B in a higher range.

Accordingly, the receptacle 40 of this embodiment is provided with the first rib 61 to partition the clearance into a first section A1 on a lower side and a second section A2 on an upper side at a height position between the male terminals 20A and the male terminals 20B, and a drainage recess 70 for enhancing water drainage performance is provided in front of and continuously with the first rib 61, as shown in FIG. 5.

(Drainage Recess 70)

The drainage recess 70 is formed by making a V-shaped cut extending from the fitting opening 50 toward the first rib end 61A in the left wall 40L of the receptacle 40. The cut entirely penetrates through the left wall 40L in the lateral direction and is open forward. The drainage recess 70 includes a drainage upper edge 71 constituting an upper edge of the drainage recess 70, a back wall 72 constituting a back end of the drainage recess 70 and a drainage lower edge 73 constituting a lower edge of the drainage recess 70.

The drainage upper edge 71 is straight and inclined up toward the fitting opening 50. The front end of the drainage upper edge 71 is coupled to the fitting opening 50 at a position in front of the auxiliary rib end 621A. The rear end of the drainage upper edge 71 is above the first rib end 61A in a side view.

The drainage lower edge 73 is straight and inclined down toward the fitting opening 50. The front end of the drainage lower edge 73 is coupled to the fitting opening 50. The rear end of the drainage lower edge 73 is below the first rib end 61A in a side view.

The back wall 72 extends from the rear end of the drainage upper edge 71 to the rear end of the drainage lower edge 73. The upper end of the back wall 72 is coupled to the rear end of the drainage upper edge 71, and the lower end of the back wall 72 is coupled to the rear end of the drainage lower edge 73. In this embodiment, the back wall 72 is a flat vertical surface. The back wall 72 is coupled to and flush with the first rib end 61A.

(Drainage Route)

If water splashes from above with the female connector 101 connected to the male connector 1, the water runs in the vicinity of the fitting opening 50 of the receptacle 40 and reaches the second rib 622. Part of the water is guided to the back end of the receptacle 40 along the upper side of the second rib 622, and the remaining water flows down from the second rib 622 to reach the first rib 61. The water then is pooled on the first rib 61 (i.e. in the second section A2) and overflows on the first rib 61 and flows down from the first rib 61 to be pooled in the first section A1. However, the water is divided into upper and lower parts at the first rib end 61A and the water divided into the lower part is drained laterally and forward of the receptacle 40 along the drainage lower edge part 73.

(Functions and Effects)

According to the configuration of this embodiment, the male connector 1 into which the mating connector (female connector 101) is fittable from front includes the receptacle 40 having the forwardly open fitting opening 50 and having a tubular shape capable of accommodating the male connector 101 fit through the fitting opening 50. The drainage recess 70 penetrates in a direction intersecting the front-rear direction at the position retracted from the fitting opening 50 in the receptacle 40. The partitioning ridges 60 are retracted from the fitting opening 50 and project in a direction intersecting the front-rear direction from the receptacle 40, and the front end (first rib end 61A) of some partitioning ridges (first rib 61) is coupled to and flush with the back wall 72 of the drainage recess 70.

According to this configuration, the partitioning ridges 60 are provided at the positions retracted from the fitting opening 50 in an inserting direction of the mating connector 101. Thus, the mating connector 101 and the receptacle 40 initially can be positioned by lightly fitting the mating connector 101 into the fitting opening 50 in connecting the mating connector 101. The connecting operation then can be performed. In this way, even if the connector 1 is installed in a place difficult for a worker to see and the worker connects the mating connector 101 by touch, a feeling of fitting the mating connector 101 into the fitting opening 50 can be obtained and work efficiency is improved.

Further, the clearance is set between the outer wall of the mating connector 101 and the inner wall of the receptacle 40 to enable the connecting operation, and water can intrude into this clearance from the front. When the connector does not include the drainage recess 70, liquid spreads in the clearance due to surface tension and, for example, may form a leak passage, which shorts the terminals 20 provided in the receptacle 40 to each other, if the mating connector 101 is fit into the receptacle 40 and the liquid intrudes toward the partitioning ridges 60 from the above clearance. In contrast, according to the above configuration, since the end 61A of the some partitioning ridge 61 on the fitting side is coupled to and flush with the back wall 72 of the drainage recess 70, the clearance is eliminated at the position of the fitting side end of the partitioning ridge 61 and the liquid is divided at the some partitioning ridge 61 and drained from the drainage recess 70. In this way, the formation of the leak passage can be prevented.

The drainage recess 70 includes the drainage lower edge 73 inclined down toward the fitting opening 50.

According to this configuration, the liquid divided into upper and lower parts at the front end of the some partitioning ridge 61 is drained toward the fitting opening 50 along the drainage lower edge part 73, the formation of the leak passage across the some partitioning ridge 61 can be more reliably prevented.

The partitioning ridges 60 include the first rib 61 coupled to and flush with the back wall 72 of the drainage recess 70 and the positioning ribs 62 provided on a rear side of a part of the fitting opening 50 where the drainage recess 70 is not provided and in front of the first rib 61, and the positioning ribs 62 extend rearward from the same position in the front-rear direction. According to this configuration, the mating connector 101 is guided in a proper posture in the fitting direction by being fit into the fitting opening 50. Thus, work efficiency in fitting the mating connector 101 is good. Further, if the positioning ribs 62 are above the first rib 61, liquid is divided into upper and lower parts by the drainage recess 70 at the first rib 61 even if the liquid splashed from above flows down toward the first rib 61 from the front ends of the positioning ribs 62. Thus, the leak passage across the first rib 61 is not formed, and terminals largely affected by leakage can be arranged below the first rib 61.

The invention is not limited to the above described and illustrated embodiment and, for example, can be embodied as follows.

Although the drainage recess 70 is a forwardly open V-shaped cut in the above embodiment, the configuration of the drainage recess 70 is not limited to this. The drainage recess may be through hole penetrating the receptacle 40 in the lateral direction and closed on a front side may be used as a drainage recess. In this case, the fitting opening 50 can have no cut by eliminating a drainage groove. Thus, for example, a worker can search a fitting position by smoothly sliding the mating connector on the surface of the fitting opening 50.

Although the drainage upper edge part 71 of the drainage recess 70 has a straight shape inclined up toward the fitting opening 50 in the above embodiment, the shape of the drainage upper edge part 71 is not limited to this. For example, the drainage upper edge part 71 may have a straight shape inclined down toward the fitting opening 50. In this way, it can be prevented that liquid flowing down along the fitting opening is drawn toward the back wall along the drainage upper edge part.

Although the auxiliary rib 621 and the second rib 622 are provided at the positions above the first rib 61 on the left side wall 40L of the receptacle 40 in the above embodiment, the auxiliary rib 621 and the second rib 622 may be provided at positions below the first rib 61 or either one or both of the auxiliary rib and the second rib may be omitted.

Further, although the front ends (positioning rib ends 62) of the positioning ribs 62 are located in front of the front end (first rib end 61A) of the first rib 61 in the above embodiment, the front ends of the positioning ribs may be located behind the front end of the first rib or may be located at the same position as the front end of the first rib in the front-rear direction. Further, although the front ends (positioning rib ends 62A) of the respective positioning ribs 62 are at the same position in the front-rear direction in the above embodiment, the front ends of the respective positioning ribs may be at positions different from each other in the front-rear direction. In short, it is sufficient to form a space, into which the mating connector is lightly fit, between the respective partitioning ridges and the fitting opening of the receptacle inside the receptacle.

Although the drainage recess 70 includes the drainage lower edge part 73 in the above embodiment, a drainage recess may not necessarily include a drainage lower edge part. For example, a drainage recess may be open downward, in other words, a back wall may extend to the lower end of the receptacle. Similarly, although the drainage recess 70 includes the drainage upper edge part 71 in the above embodiment, a drainage recess may not necessarily include a drainage upper edge part. For example, a drainage recess may be open upward, in other words, a back wall may extend to the upper end of the receptacle. In this way, the shape of a mold can be simplified when the drainage recess is formed by removing the mold.

Although the front end (first rib end 61A) of the some partitioning ridge 60 is coupled to and flush with the back wall 72 of the drainage recess 70 in the above embodiment, the front end of the some partitioning ridge may be shaped to project farther forward than the back wall of the drainage recess. Specifically, "flush with" of "coupled to and flush with" means such a positional relationship of the front end of the partitioning ridge and the back wall of the drainage recess that water can be substantially divided.

LIST OF REFERENCE SIGNS

1: male connector (connector)
101: female connector (mating connector)
40: receptacle
50: fitting opening
60: partitioning ridge
61: first rib (some partitioning ridge)
61A: first rib end (front end of some partitioning ridge)
62: positioning rib
70: drainage recess
72: back wall
73: drainage lower edge

What is claimed is:

1. A connector into which a mating connector can fit from a front, comprising:

a tubular receptacle including a forwardly open fitting opening capable of accommodating the mating connector fit through the fitting opening;

a drainage recess penetrating in a direction perpendicular to a front-rear direction at a position retracted from the fitting opening in the receptacle; and partitioning ridges provided at positions retracted from the fitting opening and projecting from the receptacle in a direction intersecting the front-rear direction;

a front end of some partitioning ridge, out of the plurality of partitioning ridges, being coupled to and flush with a back wall of the drainage recess.

2. The connector of claim 1, wherein the drainage recess includes a drainage lower edge inclined down toward the fitting opening.

3. The connector of claim 2, wherein the partitioning ridges include a first rib coupled to and flush with the back wall of the drainage recess and second positioning ribs provided on a rear side of a part of the fitting opening where the drainage recess is not provided and in front of the first rib, and the positioning ribs extend rearward from the same position in the front-rear direction.

4. The connector of claim 1, wherein the partitioning ridges include a first rib coupled to and flush with the back wall of the drainage recess and second positioning ribs provided on a rear side of a part of the fitting opening where the drainage recess is not provided and in front of the first rib, and the positioning ribs extend rearward from the same position in the front-rear direction.

* * * * *